US006257307B1

(12) United States Patent
Tollivar

(10) Patent No.: US 6,257,307 B1
(45) Date of Patent: Jul. 10, 2001

(54) MAGNETIC CUSTOMIZED GARAGE DOOR SCREEN ENCLOSURE

(76) Inventor: Karl D. Tollivar, 4837 Chapello Ct., Marietta, GA (US) 30066

( * ) Notice: Subject to any disclaimer, the term of this patent is extended or adjusted under 35 U.S.C. 154(b) by 0 days.

(21) Appl. No.: 09/513,460

(22) Filed: Mar. 3, 2000

Related U.S. Application Data

(60) Provisional application No. 60/151,222, filed on Aug. 26, 1999.

(51) Int. Cl.[7] ..... E06B 3/00

(52) U.S. Cl. ..... 160/368.1; 160/354

(58) Field of Search ..... 160/368.1, 354, 160/327, DIG. 16, DIG. 18, 370.21, 369

(56) References Cited

U.S. PATENT DOCUMENTS

| | | | | |
|---|---|---|---|---|
| 3,004,592 | * | 10/1961 | Norton | 160/368.1 X |
| 3,455,366 | * | 7/1969 | Bogumil | 160/368.1 |
| 3,763,917 | | 10/1973 | Antinone . | |
| 3,805,872 | * | 4/1974 | Lorber | 160/354 |
| 4,100,957 | * | 7/1978 | Shelton | 160/368.1 |
| 4,510,986 | | 4/1985 | Schwankl | 160/354 |
| 4,909,004 | * | 3/1990 | Panttila | 160/354 X |
| 5,090,469 | * | 2/1992 | Boulanger | 160/368.1 |
| 5,271,449 | * | 12/1993 | Herrick | 160/368.1 |
| 5,323,835 | | 6/1994 | Bachmeier | 160/89 |
| 5,358,025 | * | 10/1994 | Wood | 160/368.1 |
| 5,427,169 | | 6/1995 | Saulters . | |
| 6,079,473 | * | 6/2000 | Ackerson et al. | 160/368.1 |

* cited by examiner

*Primary Examiner*—David M. Purol
(74) *Attorney, Agent, or Firm*—Clark & Brody

(57) ABSTRACT

A magnetic customized garage door screen includes a screen surrounded by a border. The border includes magnetic strips that are designed to interface with metal strips located on a garage door. The magnetic strips can be secured to the border using adhesives and the metal strips can be secured to the door frame using double-sided tape. The door screen can also include a zipper or handles along a side thereof to allow entry into or exit from the garage. At least the border and metal strips are color matched to the color of the door frame so that the metal strips are inconspicuous when exposed and the border blends in with the door frame color when installed.

17 Claims, 2 Drawing Sheets

MAGNETIC CUSTOMIZED GARAGE DOOR SCREEN ENCLOSURE

This application claims priority from provisional patent application Ser. No. 60/151,222 filed on Aug. 26, 1999 under 35 U.S.C. §119.

FIELD OF THE INVENTION

The present invention is directed to a magnetic customized garage door enclosure, and in particular, to an enclosure using magnetic and metal strips for attachment and having color coding to match the garage door frame and dwelling colors.

BACKGROUND ART

In the prior art, garage door screens have been proposed in U.S. Pat. No. 5,427,169 to Saulters and U.S. Pat. No. 3,763,917 to Antinone. In the Saulters patent, a screen enclosure is disclosed for attachment to a garage door frame having a passageway, which can be opened and closed using a pair of double-sided zippers. Fasteners such as strips of hooks and loops sold under the trademark VELCRO® are used for attaching the perimeter of the screen to the garage opening.

The Antinone patent discloses a detachable, flexible screen for protecting garages, porches, terraces, and summer houses from annoying pests. Antinone describes the screen as a sheet of mesh screening material, a binding for the screening material with the width of a lower horizontal binding being larger than the vertical or upper horizontal binding, a fastening means, a top flap, and a side flap. The binding should be flexible to allow the screen to be folded. Antinone describes the fastening means as studs, snap buttons, hook, and the like. The screen can include a zipper.

However, these prior art screens are not without their problems. The Antinone screen is disadvantageous in that the zipper travels around the corner of the screen, and the screen is cumbersome to install, maintain, and use. Further, these types of fasteners do not lend themselves to a positive seal and the hardware is unsightly when exposed, i.e., when the screen is not in place.

The screen disclosed in the Saulters patents also has its disadvantages in that it is weighty and therefore cumbersome to install and manipulate. The presence of three panels, two zippers and dowels contribute to the bulkiness and overall cost of the enclosure. The hook and loop fasteners can be adversely affected by the weather, require adjustment during the fitting process and have limited color selection. In addition, the presence of the fasteners on the garage door frame is unsightly when the screen is not in place. Using hook and loop fasteners also creates a non-rigid screen which makes installation difficult.

In view of the numerous drawbacks to the garage enclosures of the prior art, a need has developed to provide an improved garage door screen that overcomes the disadvantages of the prior art. In light of this need, the present invention provides an improved garage door screen enclosure that provides, inter alia, a tight seal, an enclosure that does not require any tools for installation, and one that is color-coded to the dwelling decor to present a pleasing appearance whether or not the enclosure is installed.

SUMMARY OF THE INVENTION

Accordingly, it is a first object of the present invention to provide an improved garage door screen enclosure.

Another object of the present invention is a garage door screen enclosure that utilizes magnetic strips to make a tight seal around the garage door periphery.

Yet another object of the invention is a garage door screen enclosure that can be customized, including being color coded so that the screen enclosure and its mounting hardware match the color of the surrounding framing.

A further object of the present invention is a garage door screen enclosure that retains it configuration for installation, thereby easing the installation process, particularly for shorter users.

A still further object of the invention is a garage door screen enclosure that is easily adjusted after being installed, and has paintable attachment features so that the attachment features can readily color coordinate with a dwelling's décor.

Further objects and advantages of the invention will be apparent as a description of the invention continues.

In satisfaction of the foregoing objects and advantages, the present invention provides an improved garage door screen enclosure for a door frame having a top door frame portion and two side door frame portions. The enclosure comprises a screen, and a border. The border further comprises a top leg, opposing side legs, and a bottom leg, the border surrounding and connecting to the screen, and being sized to align with the door frame The enclosure also includes a top magnetic strip, and a pair of side magnetic strips, and a top metal strip, and a pair of side metal strips. Either the magnetic strips or the metal strips are attached to the top leg and opposing side legs of the border. The other of the magnetic strips and the metal strips are then attached to the door frame. In addition, either the metal strips or the magnetic strips, depending on which are attached to the door frame, and at least an outward surface of the border are made or modified so that each generally match a color of the door frame. In this way, a pleasing appearance is presented whether or not the enclosure is in place.

The enclosure can employ one or more zippers for ingress into and egress out of the garage space. Alternatively, one or more handles can be located along a portion of the border to allow a person to move the enclosure for such ingress or egress.

The screen can also match the color of the component attached to the door frame and the border if so desired, or can be reflective for privacy.

The border can include a flap along a bottom leg thereof to further seal the garage space from unwanted insects and the like. The flap can have fasteners to allow attachment in a generally vertical configuration to the bottom leg if it is desired to have the flap off a ground surface. The flap or bottom leg can use an insect repellant such as a no-pest strip to further ward off insects.

The border can be made of any material allowing the color-coding such as a fabric, a polymer such as vinyl, leather, and the like.

The metal strips and the magnetic strips can be attached or mounted to the door frame and/or border using a variety of fastening techniques and devices. In one mode, the metal strip, either as one strip or a number of strips, can be secured to the door frame using double sided weather resistant tape. The magnetic strip or strips located along a periphery of the border can be glued in place or sewn into the border. Similarly, the border can support the metal strip(s) and the door frame can support the magnetic strips.

When installing the enclosure, the components selected for the door frame are mounted thereon and the border with the corresponding strip, magnetic or metal, is then placed adjacent the component-containing door frame. The magnetic attraction between the magnetic strips and the metal strips then draws the border to the door frame to form a tight seal. During the installation, the rigidity of the magnetic strips and/or metal strips helps maintain a rectangular or square shape of the border to more easily align with the door frame.

BRIEF DESCRIPTION OF THE DRAWINGS

Reference is now made to the drawings of the invention wherein.

DESCRIPTION OF THE PREFERRED EMBODIMENTS

The present invention offers significant improvements over prior art attempts to enclose or screen in a garage. The advantages include:

No tools are need for installation or removal;

The materials of construction are weather-, rust- and stain-resistant, including the screening, the border, and fasteners associated with the enclosure;

Installation is readily accomplished by merely allowing the magnetic strips to stick to the metal strips;

A tight seal around the perimeter of the garage door opening is attained;

All components are capable of being color-coded together to match the color of the dwelling surrounding architecture, including the screen, the border, the metal strips and/or the magnetic strips;

No interference occurs with the garage door operation;

The enclosure can roll to one side when not in use, can roll in other directions if needed, and can roll up for storage;

The overall cost to manufacture is low since there are no moving parts and the enclosure is lightweight;

Due to the rigidity of the metal or magnetic strips, the enclosure retains its shape, particularly at the corners to ease installation;

Reflective screening can be employed to afford privacy and ventilation at the same time;

A screened-in room can be created out of a garage space with minimum cost and effort;

A no-pest strip can be incorporated into a part of the border to further ward off insects;

The enclosure is easily adapted to accommodate different size openings; and

When using a zipper, one or more zippers can be located in a number of locations.

Figure 1:
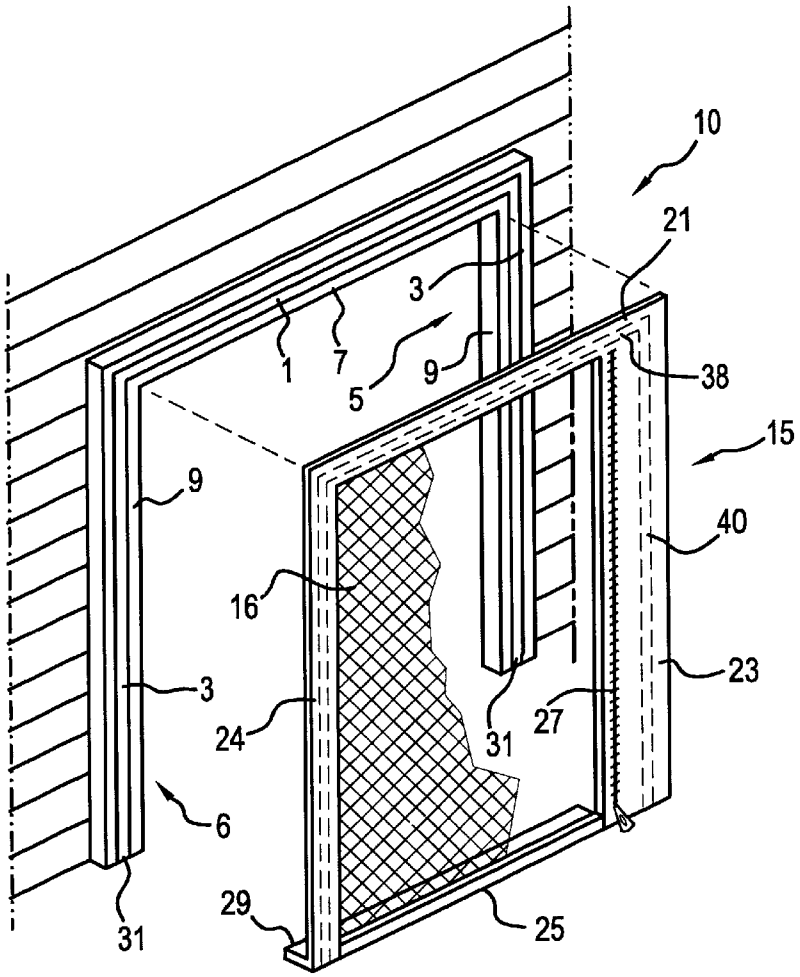
FIG. 1 is a perspective view of one embodiment of the garage door screen enclosure.

Referring now to FIG. 1, one embodiment of the inventive enclosure is generally designated by reference numeral 10 and includes a metal strip made up of a top strip 1 and side strips 3. Each of the strips 1 and 3 is mounted to a door frame 5, the top strip 1 mounted to the top garage door portion 7, and the side strips 3 mounted to the side garage door frame portions 9. The door frame 5 is preferably a garage door frame that allows entry into a garage space 6. However, it is anticipated that the screen enclosure could be adapted for other applications wherein it is desired to have a removable screen cover an opening.

The enclosure 10 also includes a border and screen assembly 15, which comprises a screen 16 and a border 19 surrounding the screen 16. The screen 16 can be secured to the border 19 in any fashion such as through stitching, adhesives, fasteners, and the like. The border 19 has four parts, a top leg 21, a pair of side legs 23 and 24, and a bottom leg 25. The side leg 23 can include a zipper 27 as a part thereof. The zipper 27, preferably a heavy duty nylon double pull zipper, allows ingress and egress to the space 6 of the garage. The border 19 can be made of any material such as a polymeric material, e.g. vinyl, canvas, another type of fabric, leather, and the like, and the zipper 27 can be attached to the border in any conventional fashion. The zipper 27 can be sewn into the left or right border legs 23 or 24, and on the inside of the magnetic strips as shown in FIG. 1.

The border and screen assembly 15 can be sized to include a flap 29 which folds under where the side legs 23 and 24 meet the terminal ends 31 of the metal strips 3, and the bottom leg 25 rests on the ground surface. The flap 29 helps form a seal at the bottom of the enclosure 10 to deter insect entry into the space 6. In FIG. 1, the bottom leg 25 is sized so that the leg 25 is visible when viewing the enclosure 10 from the outside. Alternatively, the bottom leg 25 of the border 19 could be sized so that the screen 16 terminates at the ground surface and the bottom leg 25 doubles as the flap 29, see FIG. 5.

Figure 2:
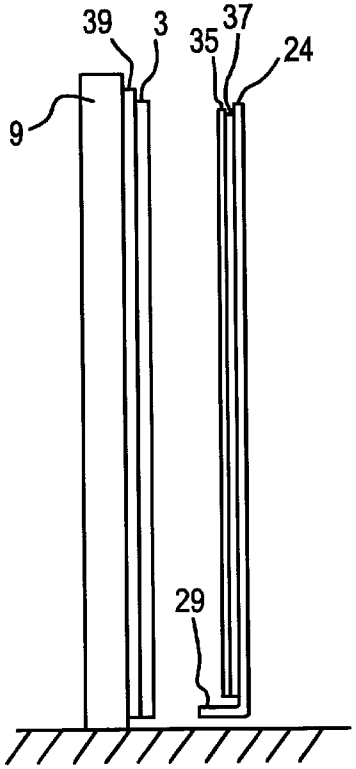
FIG. 2 is a side view of the embodiment of FIG. 1.

The border and screen assembly 15 also includes magnetic strips 35, 38, and 40 for attachment to the door frame 5. Referring to FIG. 2, the border side leg 24 is depicted with a magnetic strip 35 along a length thereof. The magnetic strip 35 is secured to the border side leg 24 using an adhesive 37. A similar mode of attachment would occur for magnetic strips 38 and 40. The metal strip 3 can be mounted to the side door frame portion 9 using a weather resistant double-sided adhesive tape 39. Of course, other modes of attachment may be used to mount the metal strips to the door frame as well as the magnetic strips to the border. For example, the metal strips could be glued to the door frame or attached using fasteners, or the like. Similarly, the magnetic strips can be mounted to the border using different techniques, tape, fasteners or the like. The magnetic strips 35, 38, and 40 interface with the metal strips 7 and 9 as described in more detail below to secure the screen and border assembly 15 to the door frame 5.

Figure 3:
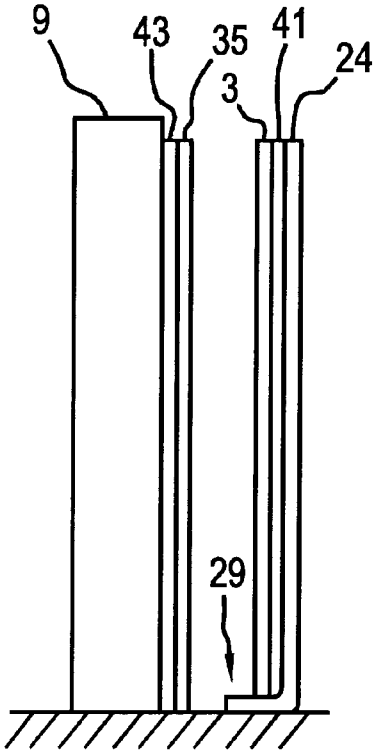
FIG. 3 is a side view of a second embodiment of the garage door screen enclosure.

In another embodiment, the metal strips could be mounted to the screen and border enclosure 15 and the magnetic strips could be mounted to the door frame 5. FIG. 3 shows such an embodiment whereby the metal strip 3 is glued via the adhesive 41 to the side leg 24 of the border 19 and the magnetic strip 35 is mounted to the door frame side portion 9 using double-sided adhesive tape 43. In both of the FIG. 2 and 3 embodiments, a magnetic attraction between the metal strips and the magnetic strips form a tight seal around the periphery of the door frame 5, while still allowing light and air to enter the space 6.

Figure 4:
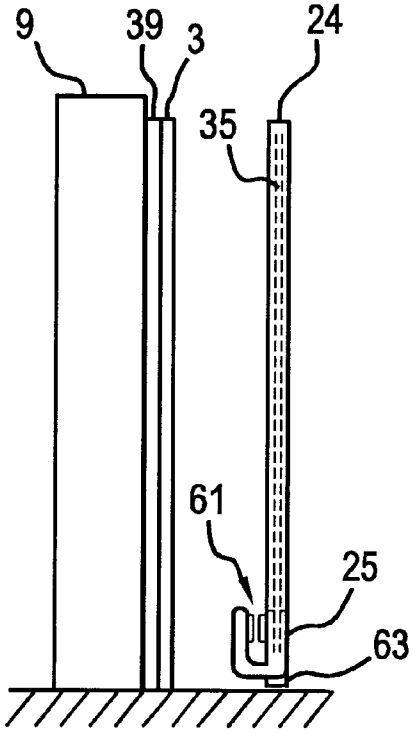
FIG. 4 is a side view of a third embodiment of the garage door screen enclosure.

FIG. 4 shows another embodiment whereby the magnetic strip 35 is sewn within the border leg 24. Even though a layer of the border material is positioned between the magnetic strip 35 and the metal strip 3, the two strips are attracted to maintain the seal noted above. It should be understood that the mounting variations described for FIGS. 2 and 3 also apply to FIG. 4. For example, the metal strip 3 could be sewn into the border leg 24 or alternative ways to mount the strip, whether magnetic or metal, to the door frame 5 may be employed.

Referring again to FIG. 1, the border 19 is color-coded to match the color of the door frame 5. Similarly, the metal strips 7 and 9 are also color-coded to match the door frame color. The metal strips may be primed and painted by the homeowner or installer or made with the desired hue or color so that when installed, they are virtually indistinguishable from the door frame 5 when the screen and border assembly 15 is not in use. Thus, a person looking at the dwelling having the door frame 5 does not even notice the presence of the metal strips 7 and 9.

As noted above, the border 19 is color-coded to match the door frame color. Since the border can be made out of a number of different materials, it can be readily made in a color to match the decor or color of the door frame of the dwelling. In this way, when the screen and border assembly 15 is in place, the periphery of the enclosure blends into the door frame and presents a pleasing appearance to an onlooker.

Figure 5:
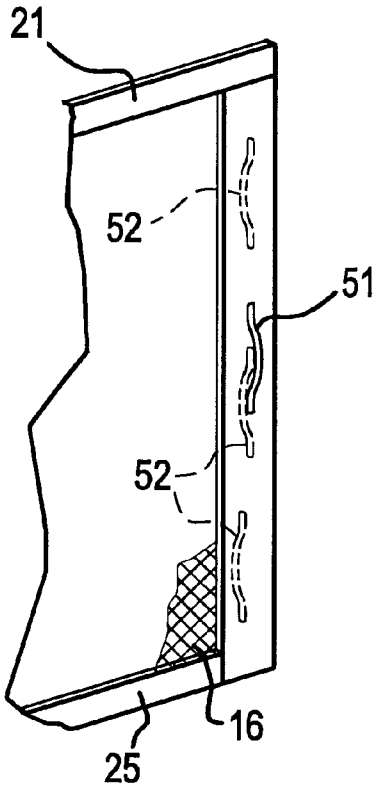
FIG. 5 is a perspective view of another embodiment of the invention.

In yet another embodiment, more than one zipper 27 can be employed. For example, a zipper could be used on each side of the enclosure 10 so that the garage space 6 can be accessed from either side. The zipper could be centrally located with the appropriate support running along the center section of the enclosure, particularly if a double garage door frame is being retrofitted with the inventive enclosure. Alternatively, the one or more zippers could be replaced with one or more straps or handles 51 on the outer surface of the border leg 23, see FIG. 5. The handles can be attached in any fashion, e.g., stitching, gluing, or the like. FIG. 5 also shows handles 52 on the inside of the border leg 23 to facilitate moving the enclosure 10 to exit the garage space 6. Although one handle is shown on the outside of the leg 23 and three handles are shown on the inside of the leg 23, one or a number of handles may be utilized on the inside or outside of the border 19. A preferred embodiment is one handle on the outside and three handles on the inside.

When installing the inventive enclosure described in FIG. 1, the metal strips 7 and 9 would be mounted to the door frame 5. Then, the screen and border assembly with the magnetic strips 35, 38, and 40 located along a back portion thereof would be positioned so that the magnetic strips adhere to the metal strips 7 and 9. Once adhered, the screen and border assembly 15 can be slid or shifted so that the magnetic strips and metal strips align and the enclosure is generally square to the door frame, i.e., not askew. The enclosure can be easily removed by pulling it away from the metal strips on the door frame and either rolling it up for storage or storing it in a configuration matching the door frame configuration.

An important advantage of using the metal or magnetic strips in the screen and border assembly 15 is that the strips in the border 19 maintain the generally square shape in the corners of the enclosure 10. By maintaining the square shape, the enclosure is more easily aligned with the door frame. This contrasts with the prior art models using hook and loop fasteners or hooks and the like. These prior art enclosures lack the rigidity of the inventive enclosure and do not retain the as-installed shape nearly as well as does the instant invention. Consequently, the inventive enclosure is more easily installed, particularly for users who are shorter in height and may have difficulty reaching the top and/or corner portions of the door frame. Since the enclosure 10 does not require any pressing of hook and loop fasteners or attachment of hooks or the like, a user merely has to generally align the strips and the magnetic attraction does the rest. Once installed, the enclosure can then be easily shifted for the proper alignment.

The screen 16 can be made of any type of screen material such a fiberglass, a polymer, or the like. The screen can also be color-coded to match the door frame and border color. In addition, the screen could be made reflective to afford a measure of privacy in the garage space while still allowing ventilation and light transmission, e.g., use a silvery or other shiny or reflective type screen.

Referring again to FIG. 4, the flap 29 can also employ fasteners to hold it upright rather than horizontal as shown in FIG. 1. In the FIG. 4 embodiment, the flap 29 could have hook and loop fasteners 61, hooks located on the flap 29 and loops located on the border leg 25. Of course, other fasteners could be utilized to align the flap 29 in a vertical orientation.

The screen and border assembly 15 could be constructed so that the bottom leg 25 is weighted along its entire length or at spaced apart intervals to enhance contact with the ground surface. The flap 29 could also employ a no-pest strip or other insect repellant on a portion of a surface thereof. For example, a no-pest strip 63 could be located along the bottom leg 25 and between the leg surface and the ground surface, see FIG. 4. In this way, insects would have to travel past the strip before entering the space 6. When no flap is used, the insect repellant could be affixed to the bottom leg 25, or the strip could be secured to the flap 29.

Although the metal and magnetic strips are described as individual pieces for the sides and top of the enclosure and the door frame, the strips can be fabricated as one piece so that the corner junction between each of the sides and the top of the door frame or the border is continuous. In addition, the magnetic strips could be located intermittently on the door frame or the screen and border assembly. The magnetic strips in varying widths are readily available in the marketplace and a further description thereof is not deemed necessary for understanding of the invention. The thicknesses of the metal strips and magnetic strips can vary depending on the particular application. Examples of gauges for the magnetic strips include from 0.030 inches, 0.060 inches and greater. The metal strip gauge can be any type as long as it has sufficient structural integrity and rigidity to either be attached to the door frame 5 or the border 19. In addition, the strength of the magnetic strips can be altered depending on the weight of the screen and border assembly 15. A heavier weight screen and border assembly may dictate stronger magnets to assure a good seal when the enclosure is in place.

An exemplary dimension for the enclosure is 86 inches high and about 110 inches across, with a border being 3 to 5 inches wide. The flap can be 2 to 5 inches in width and span the bottom leg. It should be understood that the simplicity of the enclosure allows for customization by the customer. For example, the enclosure can be made to order with the right colors and the customer can either paint the strips attached to the door frame or request that the strips be prepainted or colored. The types of egress can also be specified as can the screen type and color, overall dimensions, existence of a flap and insect repellant, and the like.

The enclosure 10 can be easily stored by merely rolling it into a cylindrical shape and using a fastening device to keep it from unraveling. One such device could be a strap or the like that has hook and loop fasteners on opposite ends. Once the enclosure is rolled up (with the flap 29 secured to the leg 25), one or more straps can then be positioned around the roll with the hooks meeting the loops to keep the strap ends together. Of course, other devices could be used to keep the roll together.

While the enclosure is disclosed for a garage door opening, it could be adapted for other opening, including those that would have a frame portion along the opening bottom so as to require a metal and magnetic strip in association with the border bottom leg 25.

In a further embodiment, a pair of magnetic strips could be used for mounting, one on the enclosure and the other on the door frame. The magnetic poles are arranged so that the opposing strips attract rather than repel in this mode.

As such, an invention has been disclosed in terms of preferred embodiments thereof which fulfills each and every one of the objects of the present invention as set forth above and provides a new and improved garage door screen and method of installation.

Of course, various changes, modifications and alterations from the teachings of the present invention may be contemplated by those skilled in the art without departing from the intended spirit and scope thereof. It is intended that the present invention only be limited by the terms of the appended claims.

What is claimed is:

1. A garage door screen enclosure including a door frame having a top door frame portion and two side door frame portions:

a) a screen;

b) a hollow fabric border further comprising a top leg, opposing side legs, and a bottom leg, the hollow fabric border surrounding and connecting to the screen, and sized to align with the door frame;

c) a top magnetic strip, and a pair of side magnetic strips;

d) a top metal strip, and a pair of side metal strips;

e) whereby the top magnetic strip and the pair of side magnetic strips are sewn in the hollow fabric border and the top metal strip and pair of side metal strips are attached to the top portion and two side portions of the door frame, respectively; and f) wherein either the metal strips or the magnetic strips, and at least an outward surface of the hollow fabric border generally match a color of the door frame.

2. The garage door screen enclosure of claim 1, further comprising a means for ingress and egress for a garage space adjacent the garage door frame.

3. The garage door screen enclosure of claim 2, wherein the means for ingress and egress is at least one zipper.

4. The garage door screen enclosure of claim 2, wherein the means for ingress and egress is at least one handle mounted to the border on each side thereof.

5. The garage door screen enclosure of claim 4, wherein one handle is mounted on one side of the border and a plurality of handles are mounted on an opposite side of the border.

6. The garage door screen enclosure of claim 1, wherein the metal strips are mounted to the door frame.

7. The garage door screen enclosure of claim 1, wherein the metal strips are mounted to the door frame using double-sided adhesive tape.

8. The garage door screen enclosure of claim 1, further comprising a flap extending along the bottom leg.

9. The garage door screen enclosure of claim 8, further comprising fasteners for securing the flap adjacent the bottom leg in a generally vertical orientation when the border in secured to the garage door frame.

10. The garage door screen enclosure of claim 1, wherein the top and side metal strips are magnetic.

11. The garage door screen enclosure of claim 1, wherein the screen has a color generally matching the color of the door frame.

12. A garage door screen enclosure including a door frame having a top door frame portion and two side door frame portions comprising:

a) a screen;

b) a border further comprising a top leg, opposing side legs, and a bottom leg, the border surrounding and connecting to the screen, and sized to align with the door frame;

c) a top magnetic strip, and a pair of side magnetic strips;

d) a top metal strip, and a pair of side metal strips;

e) whereby the top magnetic strip and the pair of side magnetic strips are attached to one of:

i) the top leg and opposing side legs of the border, respectively; and ii) the top portion and two side portions of the door frame, respectively;

with the top metal strip and pair of side metal strips attached to the other of:

i) the top leg and opposing side legs of the border, respectively; and ii) the top portion and two side portions of the door frame, respectively; and f) wherein either the metal strips or the magnetic strips, and at least an outward surface of the border generally match a color of the door frame, wherein the bottom leg has an insect repellant on a surface thereof.

13. A garage door screen enclosure including a door frame having a top door frame portion and two side door frame portions comprising:

a) a screen;

b) a hollow fabric border further comprising a top leg, opposing side legs, and a bottom leg, the hollow fabric border surrounding and connecting to the screen and sized to align with the door frame;

c) at least one metal strip mounted to the top door frame and opposing side door frame portions; and d) at least one magnetic strip sewn in the hollow fabric border to align with the at least one metal strip;

wherein the at least one metal strip and an outward surface of the hollow fabric border generally match a color of the door frame.

14. The garage door screen enclosure of claim 13, wherein the at least one metal strip is mounted to the door frame using double-sided adhesive tape, and the enclosure has at least one zipper for ingress into and egress out of a space adjacent the door frame.

15. The garage door screen enclosure of claim 13, wherein the screen has a color generally matching the color of the border.

16. The garage door screen enclosure of claim 13, wherein the bottom leg of the border has a flap extending therefrom.

17. The garage door screen enclosure of claim 13, wherein the metal strips are painted to match the color of the door frame.

* * * * *

UNITED STATES PATENT AND TRADEMARK OFFICE

CERTIFICATE OF CORRECTION

PATENT NO. : 6,257,307 B1
DATED : July 10, 2001
INVENTOR(S) : Tollivar

It is certified that error appears in the above-identified patent and that said Letters Patent is hereby corrected as shown below:

Title page,
Item [76], inventor, "Tollivar" should read -- Tolliver --; and "Chapello" should read -- Chapelle --.

Signed and Sealed this

Sixteenth Day of April, 2002

*Attest:*

*Attesting Officer*

JAMES E. ROGAN
*Director of the United States Patent and Trademark Office*